US010435635B2

(12) United States Patent
Hoehn et al.

(10) Patent No.: US 10,435,635 B2
(45) Date of Patent: Oct. 8, 2019

(54) HYDROCRACKING PROCESS AND APPARATUS WITH HEAVY POLYNUCLEAR AROMATICS REMOVAL FROM A REBOILED COLUMN

(71) Applicant: UOP LLC, Des Plaines, IL (US)

(72) Inventors: Richard K. Hoehn, Mount Prospect, IL (US); Donald A. Eizenga, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 151 days.

(21) Appl. No.: 15/476,543

(22) Filed: Mar. 31, 2017

(65) Prior Publication Data

US 2018/0282642 A1 Oct. 4, 2018

(51) Int. Cl.

| | |
|---|---|
| ***C10G 49/22*** | (2006.01) |
| ***C10G 67/02*** | (2006.01) |
| ***C10G 47/36*** | (2006.01) |
| ***C10G 47/00*** | (2006.01) |

(52) U.S. Cl.

CPC ..... *C10G 49/22* (2013.01); *C10G 47/00* (2013.01); *C10G 47/36* (2013.01); *C10G 67/02* (2013.01)

(58) Field of Classification Search

CPC ..... C10G 47/00; C10G 47/36; C10G 49/22; C10G 67/02

See application file for complete search history.

(56) References Cited

U.S. PATENT DOCUMENTS

| | | | | |
|---|---|---|---|---|
| 3,130,006 | A | 4/1964 | Rabo et al. | |
| 4,363,718 | A | 12/1982 | Klotz | |
| 4,447,315 | A | 5/1984 | Lamb et al. | |
| 5,120,427 | A * | 6/1992 | Stine | C10G 49/22 208/100 |
| 6,379,535 | B1 | 4/2002 | Hoehn et al. | |
| 6,858,128 | B1 | 2/2005 | Hoehn et al. | |
| 8,852,404 | B2 | 10/2014 | Hoehn et al. | |
| 8,877,040 | B2 | 11/2014 | Hoehn et al. | |
| 2012/0125819 | A1* | 5/2012 | Van Doesburg | C10G 49/22 208/212 |
| 2013/0220885 | A1* | 8/2013 | Low | C10G 47/00 208/85 |

* cited by examiner

*Primary Examiner* — Renee Robinson

(74) *Attorney, Agent, or Firm* — Paschall & Maas Law Office, LLC; James C. Paschall

(57) ABSTRACT

A process and apparatus removes HPNA's from a fractionated bottoms stream from a reboiled product fractionation column that obtains heat from a reboiler. HPNA's are removed from the fractionated bottoms stream by stripping it with an inert gas. The HPNA lean stream may be fed back to the reboiled product fractionation column at the same elevation as the feed stream to the column.

14 Claims, 2 Drawing Sheets

HYDROCRACKING PROCESS AND APPARATUS WITH HEAVY POLYNUCLEAR AROMATICS REMOVAL FROM A REBOILED COLUMN

FIELD

This field generally relates to a process and apparatus for removing HPNA's from a hydrocracked stream.

BACKGROUND

Heavy polynuclear aromatic (HPNA) compounds may be a secondary byproduct from a hydrocracking process. The HPNA compounds can be a problem particularly for high conversion hydrocracking units, and be present in the reactor product. Recycling unconverted oil to increase yields of distillate product can result in an accumulation of HPNA compounds in the recycled oil. Accumulated HPNA compounds in the recycle oil may deposit on the catalyst as coke, which may degrade catalyst performance and result in shorter catalyst cycle length. Production of undesired HPNA compounds can be more pronounced for hydrocracking units processing heavier feeds. Thus, it would be desirable to remove the HPNA compounds from the unconverted oil so as to minimize the catalyst deactivation.

One way to remove HPNA's is to lower conversion by bleeding a portion of the unconverted oil to limit the accumulation of HPNA compounds. Unfortunately, this is often undesirable due to economical and logistical considerations because of yield loss and lack of demand for the unconverted oil. In order to minimize the bleed rate of unconverted oil, schemes such as carbon bed absorption of the recycle oil stream to remove HPNA's and stripping columns to concentrate the HPNA's in an unconverted oil waste stream have been commercially implemented. Stripping sections for removing HPNA's have been located in the product fractionation column or in a separate stripping column downstream of the product fractionation column. Used stripping steam carrying the HPNA lean stream from the stripper have been recycled back to the product fractionation column to provide stripping steam requirements. However, no solution has been offered for removing HPNA's from a bottoms stream from a product fractionation column that utilizes a reboiler.

It would be desirable to remove HPNA's from a fractionated stream exiting a product fractionation column that utilizes a reboiler for column heat requirements.

SUMMARY

A process and apparatus removes HPNA's from a fractionated bottoms stream from a product fractionation column that obtains heat from a reboiler. HPNA's are removed from the fractionated bottoms stream by stripping it with an inert gas. The HPNA lean stream is fed back to the product fractionation column at the same elevation as the feed stream to the column. The performance of the HPNA stripper was unexpectedly better when the HPNA lean stream was routed to the fractionator feed location, rather than routing the HPNA lean stream to the bottom of the product fractionation column, as is the case for steam stripped fractionators.

Definitions

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., $C3^{+}$ or $C3^{-}$, preferably is inclusive of the abbreviated one or more hydrocarbons. As an example, the abbreviation "$C3^{+}$" means one or more hydrocarbon molecules of more than three carbon atoms an preferably three and more carbons.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without passing through a fractionation or conversion unit to undergo a compositional change due to physical fractionation or chemical conversion.

As used herein, the term "rich" can identify a stream from a separation unit such as a stripper that has a greater concentration of a compound or a class of compounds than in a feed stream to the separation unit.

As used herein, the term "lean" can identify a stream from a separation unit such as a stripper that has a smaller concentration of a compound or a class of compounds than in a feed stream to the separation unit.

As used herein, the term "substantially" can mean an amount of at least generally about 80%, preferably about 90%, and optimally about 99%, by mole, of a compound or class of compounds in a stream.

As used herein, the term "hydrocracking" can refer to a process for cracking hydrocarbons in the presence of hydrogen, and optionally a catalyst, to lower molecular weight hydrocarbons typically represented by a lowering of the boiling point of the hydrocracked stream relative to the feed stream.

As used herein, the term "heavy polynuclear aromatics" may be abbreviated "HPNA" and can characterize compounds having seven, and preferably, ten or more condensed "benzene rings" typically produced in a hydrocracking reaction zone.

As used herein, the term "fluid" can mean one or more gases or one or more liquids.

As used herein, the term "gas" can mean a single gas or a solution of a plurality of gases.

As used herein, the term "liquid" can mean a single liquid, or a solution or a suspension of one or more liquids with one or more gases and/or solid particles.

As used herein, the term "top" can be at or near the top of a vessel.

As used herein, the term "bottom" can be at or near the bottom of a vessel.

As used herein, the term "non-distillable component" can include finely divided particulate matter that can tend to foul hot heat exchange surfaces, form coke on catalyst, deactivate catalyst, and/or plug catalyst beds. Generally, the finely divided particulate matter can include polymerized organic matter.

The term "column" means a distillation column or columns for separating one or more components of different volatilities. Unless otherwise indicated, each column includes a condenser on an overhead line of the column to condense and reflux a portion of an overhead stream back to the top of the column and a reboiler at a bottom of the column to vaporize and send a portion of a bottoms stream back to the bottom of the column. Feeds to the columns may be preheated. Unless otherwise indicated, the top pressure is the pressure of the overhead vapor at the vapor outlet of the column, and the bottom temperature is the liquid bottom outlet temperature. Unless otherwise indicated, overhead lines and bottoms lines refer to the net lines from the column downstream of any reflux or reboil to the column. Stripping columns may omit a reboiler at a bottom of the column and instead provide heating requirements and separation impetus from a fluidized inert vaporous media such as steam with optional feed preheat.

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "T5" or "T90" means the temperature at which 5 mass percent or 90 mass percent, as the case may be, respectively, of the sample boils using ASTM D-86.

As used herein, the term "initial boiling point" (IBP) means the temperature at which the sample begins to boil using ASTM D-86.

As used herein, the term "end point" (EP) means the temperature at which the sample has all boiled off using ASTM D-86.

As used herein, the term "space velocity" can include the ratio of the volume or mass of the treated material to the volume or mass, respectively, of an adsorbent or catalyst.

As used herein, the term "kilopascal" may be abbreviated "kPa" and all pressures disclosed herein are absolute; the term "hour" may be abbreviated "hr"; the term "kilogram" may be abbreviated "kg"; the term "meter-cubed" may be abbreviated "$m^3$"; and the term "liquid hourly space velocity" may be abbreviated "LHSV".

As used herein, a boiling point of a stream may be determined by ASTM Method D2887-97, unless another method is specified.

DETAILED DESCRIPTION

Figure 1:
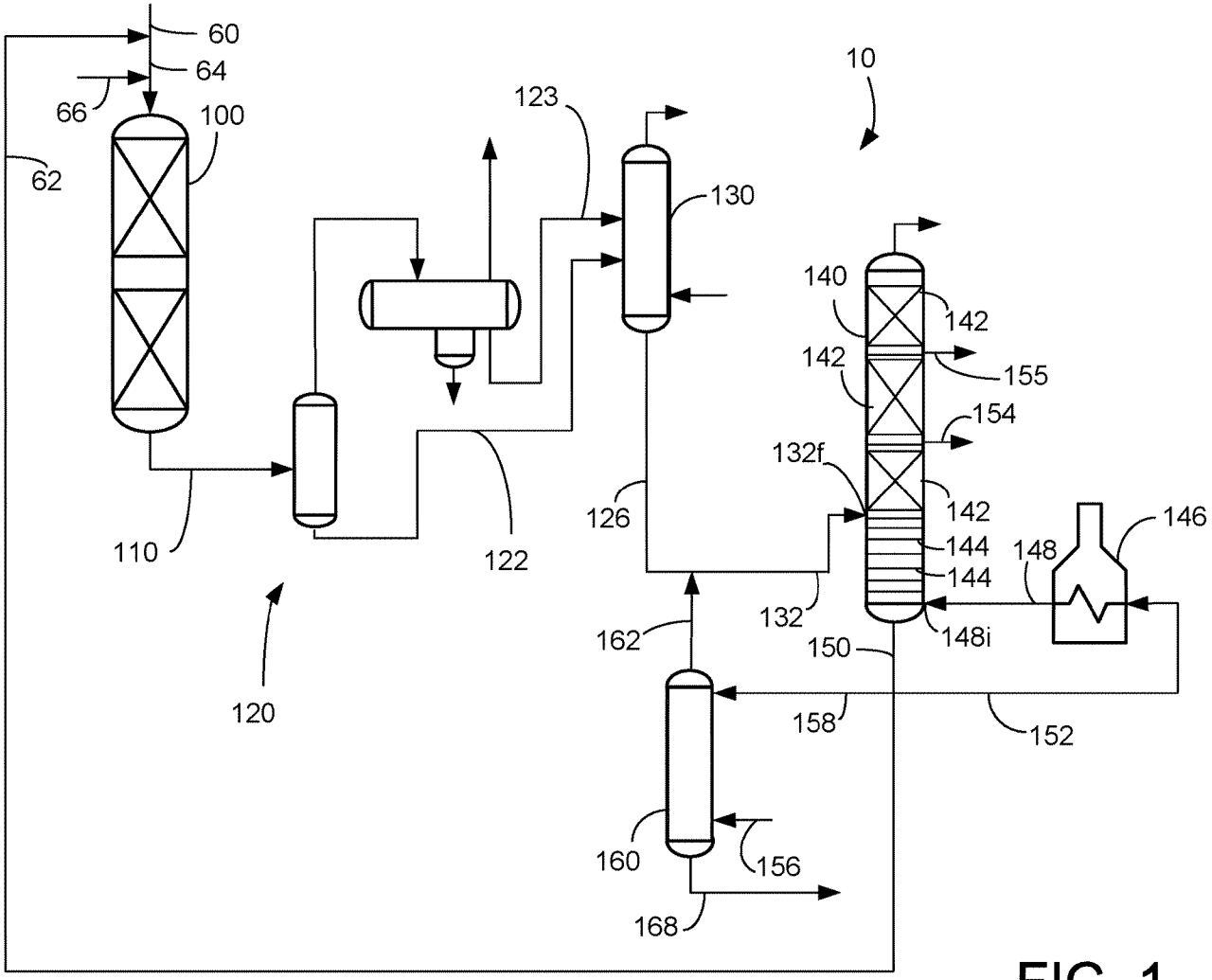
FIG. 1 is a schematic depiction of an exemplary embodiment.

Referring to FIG. 1, one exemplary embodiment of an apparatus and process 10 is depicted. The apparatus and process 10 can include a hydrocracking reactor 100, a separation zone 120, a product stripping column 130, a reboiled product fractionation column 140, and a recycle stripping column 160. A hydrocracking feed in a feed line 60 can be provided to the apparatus and process 10.

The hydrocracking feed may be a hydrocarbonaceous oil containing hydrocarbons and/or other organic materials to produce a product containing hydrocarbons and/or other organic materials of lower average boiling point and lower average molecular weight. The hydrocracking feed may include mineral oils and synthetic oils, e.g., shale oil, and tar sand products, and fractions thereof. An illustrative hydrocracking feed includes those containing components initially boiling above about 285° C., such as atmospheric gas oils; vacuum gas oils; deasphalted, vacuum, and atmospheric residua; hydrotreated or mildly hydrocracked residual oils; coker distillates; straight run distillates; solvent-deasphalted oils; pyrolysis-derived oils; high boiling synthetic oils; cycle oils; and cat cracker distillates. One exemplary preferred hydrocracking feed is a gas oil or other hydrocarbon fraction having at least about 50%, by weight, of its components boiling at temperatures above the end point of the desired product such as about 360° C. One exemplary hydrocracking feed may contain one or more hydrocarbon components boiling above about 285° C., preferably containing at least about 25%, by volume, of the components boiling between about 310° and about 540° C. The hydrocracking feed in a feed line 60 may be combined with a recycle stream in recycle line 62, as hereinafter described, to form a combined stream in combined line 64 and provided to the hydrocracking reactor 100. Hydrogen may be added to the combined stream in the combined line 64 in a hydrogen line 66 and/or directly to the hydrocracking reactor 100.

The hydrocracking reactor 100 can include a single reactor or multiple reactors, and undertake processes such as hydrocracking and hydrotreating. The hydrocracking reactor 100 can include a hydrocracking catalyst utilizing amorphous bases or low-level zeolite bases combined with one or more metals of groups 6 and 8-10 of the periodic table acting as hydrogenating metals and promoters. In another embodiment, the catalyst can include any crystalline zeolite cracking base upon which is deposited a minor proportion of a metal of groups 8-10 of the periodic table. The hydrogenating components may also be selected from group 6 of the periodic table for incorporation with a zeolite base. Hydrogenating metals can include one or more of iron, cobalt, nickel, ruthenium, rhodium, palladium, osmium, iridium and platinum and may include molybdenum and tungsten. The amount of hydrogenating metal in the catalyst can vary within wide ranges, such as about 0.05 to about 30%, by weight, based on the weight of the catalyst. In the case of the noble metals, e.g., platinum and palladium, about 0.05 to about 2%, by weight, may be used.

The zeolite bases may be referred to as molecular sieves and composed of silica, alumina and one or more exchangeable cations such as sodium, magnesium, calcium, and at least one rare earth metal. They can be further characterized by crystal pores of relatively uniform diameter of about 4 to about 14 Angstroms. Suitable zeolites may include mordenite, stilbite, heulandite, ferrierite, dachiardite, chabazite, erionite and faujasite, and beta, X, Y and L crystal types, e.g., synthetic faujasite and mordenite. Generally, one exemplary zeolite is a synthetic Y molecular sieve.

The original zeolitic monovalent metals can be ion-exchanged with a polyvalent metal and/or with an ammonium salt followed by heating to decompose the ammonium ions associated with the zeolite, leaving in their place hydrogen ions and/or exchange sites, which may be decationized by further removal of water. Exemplary hydrogen or decationized Y zeolites are disclosed in, e.g., U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, the hydrogen forms can be prepared by direct acid treatment of the alkali metal zeolites.

One preferred method for incorporating the hydrogenating metal is contacting the zeolite base material with an aqueous solution of a suitable compound of the desired metal wherein the metal may be present in a cationic form. Following addition of the selected hydrogenating metal or metals, the resulting catalyst powder may be then filtered, dried, pelleted with added lubricants, binders or the like, if desired, and calcined in air at temperatures of, e.g., about 370° to about 650° C. in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, and activated clays in proportions ranging of about 5 to about 90%, by weight, based on the weight of the catalyst. These diluents may be employed as such or they may contain a minor proportion of an added hydrogenating metal of groups 6 and 8-10 of the periodic table.

Additional metal promoted hydrocracking catalysts may also be utilized, which can include aluminophosphate molecular sieves, crystalline chromosilicates, and other crystalline silicates. Such crystalline chromosilicates are disclosed in, e.g., U.S. Pat. No. 4,363,718.

The hydrocracking of a feed with a hydrocracking catalyst can be conducted in the presence of hydrogen and preferably at hydrocracking reactor conditions at a temperature of about 230° to about 470° C., a pressure of about 3,450 to about 20,690 kPa, an LHSV of about 0.1 to about 30 $hr^{-1}$, and a hydrogen circulation rate of about 330 to about 25,000 normal $m^3/m^3$. Such feeds and hydrocracking reactors are disclosed in, e.g., U.S. Pat. Nos. 4,447,315 and 6,379,535.

A hydrocracked stream in hydrocracking effluent line 110 may be fed to a reboiled product fractionation column 140 in downstream communication with the hydrocracking reactor 100 for fractionating the hydrocracked stream. The hydrocracked stream may be first separated in a series of separators in the separation zone 120 to provide one, two or more separated liquid hydrocracked streams in lines 122 and/or 123 and stripped in a product stripping column 130 by an inert gas such as steam to remove gases, including light hydrocarbons and hydrogen sulfide, and provide a stripped liquid hydrocracked stream in a stripped line 126 prior to feeding the reboiled product fractionation column 140. The product stripping column 130 may be in downstream communication with the hydrocracking reactor 100. More than one stripping column 130 may be used perhaps for each hydrocracked liquid stream. The stripped liquid hydrocracked stream in the stripped line 126 may be fed to the reboiled product fractionation column 140 in a fractionation feed stream in a fractionation feed line 132 through a fractionation feed inlet 132*f*. A lean HPNA stream in an HPNA overhead line 162 may be added to the stripped liquid hydrocracked stream in the stripped line 126 and fed to the reboiled product fractionation column 140 in the fractionation feed line 132.

The reboiled product fractionation column 140 may include one or more trays or beds of packing 142, which can include bubble caps or other suitable vapor/liquid contacting devices. In FIG. 1, the reboiled product fractionation column includes beds of packing 142 which is particularly applicable if the reboiled product fractionation column operates in vacuum. The trays and/or packing will be located above a feed inlet 132*f* from a feed line 132 to the reboiled product fractionation column 140. Beds of packing 142 will not be located at the same elevation as a product withdrawal line such as diesel product withdrawal line 154 to accommodate a liquid collection tray to provide the product to be withdrawn. A series of stripping trays 144 may be located below and/or downstream of the feed inlet 132*f* to strip the hydrocracked material descending in the column to be withdrawn as the fractionated bottoms stream in fractionated bottoms line 150 of more volatile components. In an aspect about 5 to about 12 stripping trays 144 may be provided below the feed inlet 132*f* in the reboiled product fractionation column 140. The reboiled product fractionation column 140 can operate with a flash zone temperature of about 330° to about 390° C. and a pressure of about 13 to about 138 kPa (absolute). The fractionation column 140 may comprise two fractionation columns with the downstream fractionation column operating at vacuum pressure. The fractionation feed stream in line 132 can be fractionated in the reboiled product fractionation column 140 with the lighter components passing upward and lighter products withdrawn further up the column 140, and the heavier components exiting the column 140, such as in the fractionated bottom stream in a bottoms line 150. A diesel stream can be removed from a side of the fractionation column in the diesel product withdrawal line 154. A lighter stream such as a kerosene stream may be withdrawn from a side of the fractionation column in a kerosene withdrawal line 155.

The reboiled product fractionation column is not supplied with heat through an inert gas stream. Nor is the stripped liquid hydrocracked stream in the stripped line 126 or the fractionation feed line 132 heated in a fired heater before entering the reboiled product fractionation column. In an embodiment, the stripped liquid hydrocracked stream is fed to the reboiled product fractionation column in the fractionation feed stream in the fractionation feed line 132 at a temperature of no more than 100° C. greater than the temperature of the stripped liquid hydrocracked stream exiting the stripping column 130 in the stripped line 126. In a suitable embodiment, the stripped, liquid hydrocracked stream is fed to the reboiled product fractionation column in the fractionation feed stream in the fractionation feed line 132 at a temperature of no more than 50° C. greater than the temperature of the stripped liquid hydrocracked stream exiting the stripping column 130 in the stripped line 126. In a preferred embodiment, the stripped liquid hydrocracked stream is fed to the reboiled product fractionation column 140 in the fractionation feed stream in the fractionation feed line 132 at a temperature of no more than the temperature of the stripped liquid hydrocracked stream exiting the stripping column 130 in the stripped line 126. In a still preferred embodiment, the stripped liquid hydrocracked stream is fed to the reboiled product fractionation column 140 in the fractionation feed stream in the fractionation feed line 132 with no heating of the stripped liquid hydrocracked stream exiting the stripping column 130 in the stripped line 126. Accordingly, no fired heater and preferably no heater is provided on the stripped line 126 or the fraction feed line 132.

Instead, heating requirements are supplied to the reboiled product fractionation column 140 by reboiling a first portion as a reboiler stream in a reboiler line 152 of the fractionated bottoms stream from the fractionated bottoms line 150 in a fired heater reboiler 146 to provide a reboiled stream in a reboiled line 148. The reboiler 146 may be in downstream communication with the reboiled product fractionation column 140. The first portion in the reboiler stream of the fractionated bottoms stream in the reboiler line 152 is in the liquid phase and the reboiled stream in the reboiled line 148 is in the vapor phase. The reboiled stream is returned to the reboiled product fractionation column 140 in the reboiled line 148 below all of the stripping trays 144 at a reboiler inlet 148*i*. The reboiled product fractionation column 140 is in downstream communication with the reboiler 146. The reboiled line 148 is fluidly connected to the reboiler 146 and to the fractionation column 140. The reboiler inlet 148*i* is at a lower elevation than the feed inlet 132*f*.

A second portion of the fractionated bottom stream in the bottoms line 150 may be taken as a process stream in a process line 158 and provided to the recycle stripping column 160, which can include a drum but is preferably a packed or trayed column. The process stream in the process line 158 may comprise about two to about six percent of the feed volumetric flow rate in the feed line 60. The second portion of the fractionated bottom stream may be different from the first portion of the fractionated bottom stream. The recycle stripping column 160 may be in downstream communication with the reboiled product fractionation column 140 for stripping the process stream in the process line 158 to provide a stripped unconverted oil stream rich in HPNA's in a stripped bottoms line 168 and a stream lean in HPNA's in an overhead line 162.

The recycle stripping column 160 can be operated at any suitable conditions to strip the second portion of the fractionated bottoms stream with an inert gas such as steam from a line 156, to provide a lean stream lean in HPNA's in the overhead line 162 and a stripped unconverted oil stream in stripped bottoms line 168 rich in HPNA's. In an embodiment, the stripping column 160 may be provided in a bottom of the fractionation column 140 configured as a split shell column below the stripping trays 144 which is an embodiment that is not shown. The lean stream lean in HPNA's in the overhead line 162 may be returned to the fractionation column 140 to have valuable products recovered from it. In an aspect, the HPNA lean stream may be returned to the reboiled product fractionation column at the same elevation as the fractionation feed stream in the fractionation feed line 132 at the fractionation feed inlet 132*f*. In this aspect, the HPNA lean stream may be returned to the reboiled product fractionation column at the same tray as the fractionation feed stream in the fractionation feed line 132 at the fractionation feed inlet 132*f*. In another aspect, the lean stream lean in HPNA's in the overhead line 162 may be added to the stripped liquid hydrocracked stream in the stripped line 126 to supplementally provide the fractionation feed stream and be fed to the reboiled product fractionation column 140 in the fractionation feed line 132 through the fractionation feed inlet 132*f*. The overhead line 162 of the stripping column 160 may be in upstream communication with the reboiled product fractionation column 140 at the same elevation and/or tray as the feed inlet 132*f*. In an aspect, the overhead line 162 may be fluidly connected to the fractionation feed line 132.

The stripped unconverted oil stream in stripped line 168 can include non-distillable components such as HPNA compounds, one or more $C24^+$ hydrocarbons, and may have a boiling point of at least about 370° C. The stripped stream may be forwarded to an adsorption zone to have HPNA's adsorbed from the stripped stream or otherwise disposed. The stripped unconverted oil stream in stripped line 168 may comprise about 500 to about 3000 wppm HPNA's and suitably about 900 to about 1500 wppm HPNA's. The stripped unconverted oil stream in stripped line 168 may comprise about a third to about two-thirds of a percent of the feed volumetric flow rate in the feed line 60.

The fractionated bottom stream in bottoms line 150 can be further separated into a third portion comprising a recycle stream in a recycle line 62 that is recycled to the hydrocracking reactor 100. The third portion of the fractionated bottom stream may be different from the first portion and/or the second portion of the fractionated bottom stream. The recycle stream in the recycle line 62 may be combined with the hydrocracking feed in the feed line 60 to provide the combined stream 64, as described above.

Figure 2:
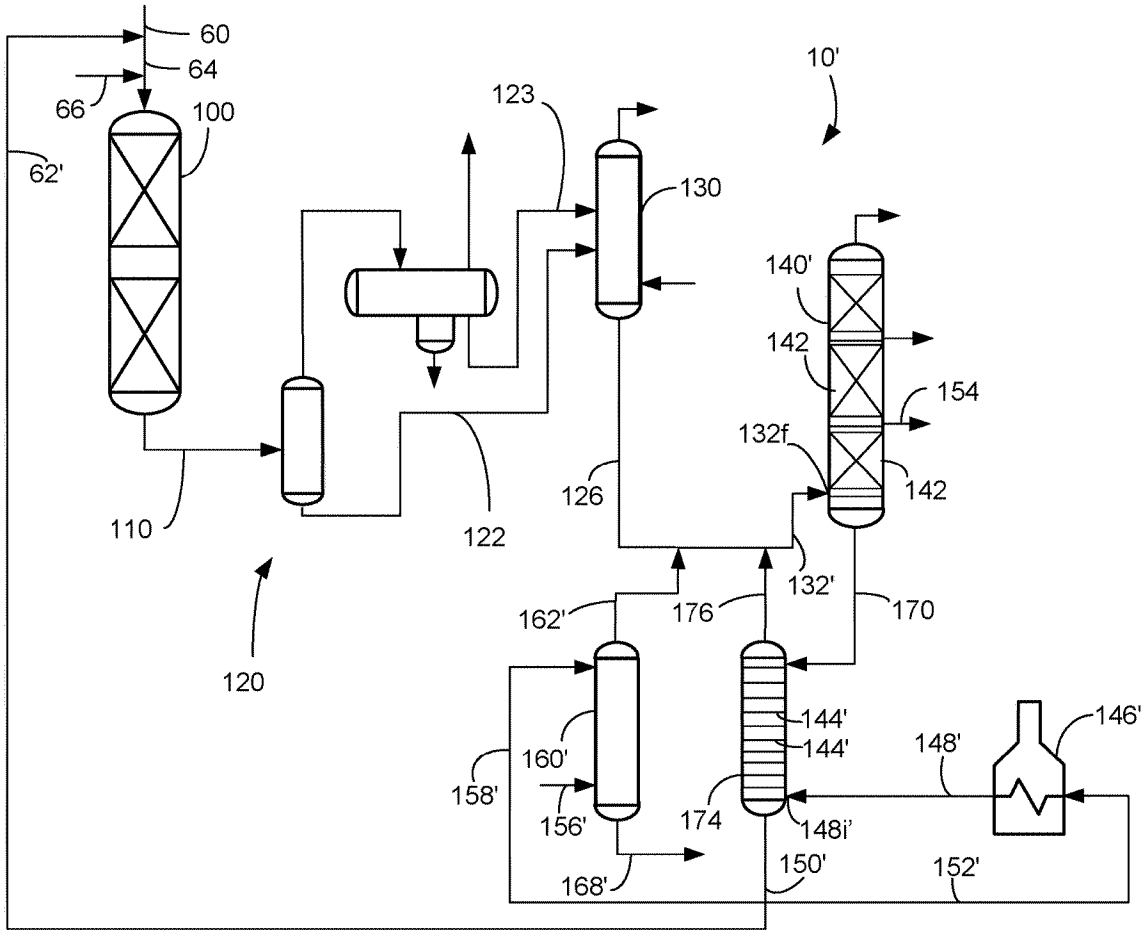
FIG. 2 is a schematic depiction of an alternative embodiment.

Alternatively, a series of stripping trays 144' may be located in a stub stripper column 174 outside of the reboiled product fractionation column 140' downstream of the feed inlet 132*f* as shown in FIG. 4 of U.S. Pat. No. 8,877,040 B2. FIG. 2 shows an embodiment of a reboiled product fractionation column which omits stripping trays below the feed inlet 132*f* from the product fractionation column 140 in the embodiment in FIG. 1. Elements in FIG. 2 with the same configuration as in FIG. 1 will have the same reference numeral as in FIG. 1. Elements in FIG. 2 which have a different configuration as the corresponding element in FIG. 1 will have the same reference numeral but designated with a prime symbol (').  The configuration and operation of the embodiment of FIG. 2 is similar to the embodiment in FIG. 1.

The reboiled product fractionation column 140' has no stripping trays below feed inlet 132*f*. An unstripped fractionated bottoms stream exits the reboiled product fractionation column 140' in fractionated bottoms line 170 and may be fed to the stub stripper column 174 equipped with the stripping trays 144' for stripping volatiles in the hydrocracked material from the unstripped fractionated bottom stream exiting the reboiled product fractionation column 140'. The stripped fractionated bottoms stream exits the stub stripper column 174 in the stripped fractionator bottoms line 150'. The stripped fractionator bottom stream in the stripped fractionator bottoms line 150' may be split into three portions. The first portion is the reboiler stream in reboiler line 152' which is reboiled in the reboiler heater 146' and returned in the reboiled line 148' to the stub stripper column 174 through a reboiler inlet 148*i'* downstream of the feed inlet 132*f* to the fractionation column 140'. The stub vaporous stream from the stub stripper column 174 in a stub overhead line 176 comprising the reboiled vapor from the reboiler 146' and volatiles stripped from the unstripped fractionated bottoms stream in the unstripped fractionated bottoms line 170 is returned to the fractionation column 140' in the fractionator feed line 132'. The second portion of the stripped fractionator bottom stream in the stripped fractionator bottoms line 150' is a process stream in a process line 158' which is fed to a recycle stripping column 160'. The process stream in the process line 158' is stripped over inert gas stream from line 156' in the recycle stripping column 160' to remove HPNA's. The overhead stream in the HPNA overhead line 162' lean of HPNA's is fed to the fractionation column 140' at the same elevation as the feed inlet 132*f*, suitably through the same tray as the fractionation feed stream in line 132' and preferably through feed line 132' along with the stub vaporous stream in the stub stripper overhead line 176. The stripped unconverted oil stream rich in HPNA's is removed from the recycle stripper 160' in a stripped line 168'. The third portion of the stripped fractionator bottom stream in the stripped fractionator bottoms line 150' comprises a recycle stream that may be recycled to the hydrocracking reactor 100 in a recycle line 62'. The rest of the embodiment of FIG. 2 operates and is configured in the same way as FIG. 1.

EXAMPLE

A simulation was performed with a recycle stripping column for removing HPNA's from a fractionated bottoms stream by stripping with steam. The reboiled product fractionation column operates with a reboiler heater in a hydrocracking unit. Ten stripping trays were provided in the bottom of the reboiled product fractionation column below the feed inlet and above the inlet for the reboiled stream. In a comparative simulation, an HPNA lean stream from the recycle stripper overhead line is fed to the bottom of the reboiled product fractionation column at the same elevation as the inlet for the reboiled stream. In an exemplary simulation, the HPNA lean stream from the recycle stripper overhead line is fed to the feed line supplying feed to the reboiled product fractionation column. Comparisons are shown in the following table. IBP, T5, T90 and EP temperatures were determined by the TBP method.

TABLE

| Bottoms Liquid Properties | Exemplary | Comparative |
|---|---|---|
| Temperature, ° F. (C.°) | 550 (287) | 545 (285) |
| Mass Flow, lb/hr (kg/hr) | 16639 (7547) | 16626 (7541) |
| Vol. Flow, BPSD (Nm3/d) | 1320 (210) | 1320 (210) |
| Mole Weight | 444.3 | 439.3 |
| Initial Boiling Point, F.° (C.°) | 728.6 (387) | 723.9 (384) |
| T5 Temperature, ° F. (C.°) | 760.6 (405) | 756.2 (402) |
| T90 Temperature, ° F. (C.°) | 981.8 (528) | 978.6 (526) |
| End Point, ° F. (C.°) | 1035.6 (558) | 1035.6 (558) |

The above table illustrates that for the same volumetric flow rate, the fractionated bottoms stream in the exemplary simulation comprises more heavy material indicating that more useful light material was lifted from the bottoms stream to be fractionated into fuel products. It was not expected that feeding more vapor to the bottom of the reboiled product fractionation column would hurt the separation because increasing the stripping steam rate normally improves the separation. However, bypassing the stripping steam from the HPNA recycle stripping column around the bottom of the reboiled product fractionation column to the feed inlet resulted in an improved separation. Hence, the surprisingly better solution is to recycle the vaporous HPNA lean stream to the elevation of the feed inlet rather than to the bottom of the reboiled product fractionation column.

SPECIFIC EMBODIMENTS

While the following is described in conjunction with specific embodiments, it will be understood that this description is intended to illustrate and not limit the scope of the preceding description and the appended claims.

A first embodiment of the invention is a process for hydrocracking, comprising hydrocracking a hydrocarbon feed stream over a hydrocracking catalyst in the presence of hydrogen to provide a hydrocracked stream; separating the hydrocracked stream to provide a liquid hydrocracked stream; feeding the liquid hydrocracked stream to a fractionation column; fractionating the liquid hydrocracked stream to provide a fractionated bottoms stream; reboiling a first portion of the bottoms stream to provide a reboiled stream; returning the reboiled stream to the fractionation column; stripping a second portion of the fractionated bottom stream to provide a stripped stream rich in HPNA's and a stream lean in HPNA's; and feeding the stream lean in HPNA's to the fractionation column at the same elevation as the liquid hydrocracked stream. An embodiment of the invention is one, any or all of prior embodiments in this paragraph up through the first embodiment in this paragraph, further comprising feeding the liquid hydrocracked stream to the fractionation column in a fractionation feed stream and wherein the stream lean in HPNA's is added to the liquid hydrocracked stream in the fractionation feed stream. An embodiment of the invention is one, any or all of prior embodiments in this paragraph up through the first embodiment in this paragraph, wherein the first portion of the fractionated bottoms stream is different from the second portion of the fractionated bottoms stream. An embodiment of the invention is one, any or all of prior embodiments in this paragraph up through the first embodiment in this paragraph, further comprising recycling a third portion of the fractionated bottom stream to the hydrocracking step. An embodiment of the invention is one, any or all of prior embodiments in this paragraph up through the first embodiment in this paragraph, wherein the first portion of the fractionated bottom stream is stripped with a steam stream. An embodiment of the invention is one, any or all of prior embodiments in this paragraph up through the first embodiment in this paragraph, wherein separating the hydrocracked stream provides a separated liquid hydrocracked stream and further comprising stripping the separated liquid hydrocracked stream to provide the liquid hydrocracked stream. An embodiment of the invention is one, any or all of prior embodiments in this paragraph up through the first embodiment in this paragraph, further comprising feeding the liquid hydrocracked stream to the fractionation column in a fractionation feed stream at a temperature no more than 100° C. greater than the temperature of the liquid hydrocracked stream exiting a stripping column. An embodiment of the invention is one, any or all of prior embodiments in this paragraph up through the first embodiment in this paragraph, further comprising feeding the liquid hydrocracked stream to the fractionation column in a fractionation feed stream from a stripping column without heating the fractionation feed stream. An embodiment of the invention is one, any or all of prior embodiments in this paragraph up through the first embodiment in this paragraph, further comprising stripping volatiles from the fractionation feed stream over stripping trays downstream of a fractionation feed inlet for feeding the liquid hydrocracked stream to the fractionation column to provide the fractionated bottoms stream. An embodiment of the invention is one, any or all of prior embodiments in this paragraph up through the first embodiment in this paragraph, wherein the volatiles are stripped from the fractionation feed stream over stripping trays that are located in a stub stripping column downstream of the product fractionation column.

A second embodiment of the invention is a process for hydrocracking, comprising hydrocracking a hydrocarbon feed stream over a hydrocracking catalyst in the presence of hydrogen to provide a hydrocracked stream; separating the hydrocracked stream to provide a separated liquid hydrocracked stream; stripping the separated liquid hydrocracked stream to provide a fractionation feed stream; feeding the fractionation feed stream to a fractionation column; fractionating the fractionation feed stream to provide a fractionated bottoms stream; stripping a first portion of the fractionated bottom stream to provide a stripped stream rich in HPNA's and a stream lean in HPNA's; adding the stream lean in HPNA's to the fractionation feed stream; reboiling a second portion of the bottoms stream to provide a reboiled stream; and returning the reboiled stream to the fractionation column. An embodiment of the invention is one, any or all of prior embodiments in this paragraph up through the second embodiment in this paragraph, wherein the first portion of the fractionated bottoms stream is different from the second portion of the fractionated bottoms stream. An embodiment of the invention is one, any or all of prior embodiments in this paragraph up through the second embodiment in this paragraph, further comprising recycling a third portion of the fractionated bottom stream to the hydrocracking step. An embodiment of the invention is one, any or all of prior embodiments in this paragraph up through the second embodiment in this paragraph, wherein the first portion of the fractionated bottom stream is stripped with a steam stream. An embodiment of the invention is one, any or all of prior embodiments in this paragraph up through the second embodiment in this paragraph further comprising feeding the fractionation feed stream at a temperature no lower than the temperature of the fractionation feed stream exiting a stripping column. An embodiment of the invention is one, any or all of prior embodiments in this paragraph up through the second embodiment in this paragraph, further comprising feeding the fractionation feed stream to the fractionation column from a stripping column without heating the fractionation feed stream.

A third embodiment of the invention is an apparatus for hydrocracking, comprising a hydrocracking reactor; a fractionation column in communication with the hydrocracking reactor for fractionating a hydrocracked stream fed to the fractionation column through a feed line through a feed inlet; a stripping column in communication with the fractionation column for stripping a fractionated stream; a reboiler in communication with the fractionation column for reboiling a fractionated stream; an overhead line of the stripping column in communication with the fractionation column at the same elevation as the feed inlet. An embodiment of the invention is one, any or all of prior embodiments in this paragraph up through the third embodiment in this paragraph, further comprising a reboiler line fluidly connecting the reboiler to the fractionation column. An embodiment of the invention is one, any or all of prior embodiments in this paragraph up through the third embodiment in this paragraph further comprising a product stripping column in downstream communication with the hydrocracking reactor, the fractionation column in downstream communication with the product stripping column through a fractionation feed line that omits a heater. An embodiment of the invention is one, any or all of prior embodiments in this paragraph up through the third embodiment in this paragraph wherein a fractionation feed inlet to the fractionation column is at a higher elevation than a reboiler inlet to the fractionation column.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for hydrocracking, comprising:

hydrocracking a hydrocarbon feed stream over a hydrocracking catalyst in the presence of hydrogen to provide a hydrocracked stream;

separating the hydrocracked stream to provide a liquid hydrocracked stream;

feeding said liquid hydrocracked stream to a fractionation column;

fractionating the liquid hydrocracked stream to provide a fractionated bottoms stream;

splitting said fractionated bottoms stream into at least a first portion and a second portion;

reboiling said first portion of the bottoms stream to provide a reboiled stream;

returning said reboiled stream to said fractionation column;

stripping said second portion of the fractionated bottom stream with a steam stream to provide a stripped stream rich in HPNA's and a stream lean in HPNA's; and feeding the stream lean in HPNA's and the steam stream to the fractionation column at the same elevation as the liquid hydrocracked stream.

2. The process according to claim 1, further comprising feeding said liquid hydrocracked stream to said fractionation column in a fractionation feed stream and wherein said stream lean in HPNA's is added to said liquid hydrocracked stream in said fractionation feed stream.

3. The process according to claim 1, further comprising recycling a third portion of said fractionated bottom stream to said hydrocracking step.

4. The process according to claim 1, wherein the stream lean in HPNA's is an overhead stream from a stripping column.

5. The process according to claim 1, wherein separating the hydrocracked stream provides a separated liquid hydrocracked stream and further comprising stripping said separated liquid hydrocracked stream to provide said liquid hydrocracked stream.

6. The process according to claim 5, further comprising feeding said liquid hydrocracked stream to said fractionation column in a fractionation feed stream at a temperature no more than 100° C. greater than the temperature of the liquid hydrocracked stream exiting a stripping column.

7. The process according to claim 5, further comprising feeding said liquid hydrocracked stream to said fractionation column in a fractionation feed stream from a stripping column without heating said fractionation feed stream.

8. The process according to claim 1, further comprising stripping volatiles from the fractionation feed stream over stripping trays downstream of a fractionation feed inlet for feeding said liquid hydrocracked stream to said fractionation column to provide said fractionated bottoms stream.

9. The process according to claim 8, wherein said volatiles are stripped from the fractionation feed stream over stripping trays that are located in a stub stripping column downstream of said product fractionation column.

10. A process for hydrocracking, comprising:

hydrocracking a hydrocarbon feed stream over a hydrocracking catalyst in the presence of hydrogen to provide a hydrocracked stream;

separating the hydrocracked stream to provide a separated liquid hydrocracked stream;

stripping said separated liquid hydrocracked stream to provide a fractionation feed stream;

feeding said fractionation feed stream to a fractionation column;

fractionating the fractionation feed stream to provide a fractionated bottoms stream;

splitting said fractionated bottoms stream into at least a first portion and a second portion;

stripping said first portion of the fractionated bottom stream with a steam stream to provide a stripped stream rich in HPNA's and a stream lean in HPNA's;

adding the stream lean in HPNA's and the steam stream to said fractionation feed stream;

reboiling said second portion of the bottoms stream to provide a reboiled stream; and returning said reboiled stream to said fractionation column.

11. The process according to claim 10, further comprising recycling a third portion of said fractionated bottom stream to said hydrocracking step.

12. The process according to claim 10, wherein the stream lean in HPNA's is an overhead stream from a stripping column.

13. The process according to claim 10, further comprising feeding said fractionation feed stream at a temperature no lower than the temperature of the fractionation feed stream exiting a stripping column.

14. The process according to claim 10, further comprising feeding said fractionation feed stream to said fractionation column from a stripping column without heating said fractionation feed stream.

* * * * *